US005957079A

United States Patent [19]

Wessels

[11] Patent Number: 5,957,079

[45] Date of Patent: Sep. 28, 1999

[54] DIVING BALLAST

[76] Inventor: Johannes Mattheus Wessels, 5 Santa Maria, 50 Orchard Road, Orchards, Johannesburg, South Africa

[21] Appl. No.: 09/029,523

[22] PCT Filed: Aug. 29, 1996

[86] PCT No.: PCT/GB96/02128

§ 371 Date: Jul. 15, 1998

§ 102(e) Date: Jul. 15, 1998

[87] PCT Pub. No.: WO97/08048

PCT Pub. Date: Mar. 6, 1997

[30] Foreign Application Priority Data

Aug. 29, 1995 [ZA] South Africa ..... 95/7234
Sep. 14, 1995 [ZA] South Africa ..... 95/7732

[51] Int. Cl.[6] ..... B63C 11/46

[52] U.S. Cl. ..... 114/315; 441/114; 405/186; 482/79

[58] Field of Search ..... 114/315; 441/114; 482/79, 105; 405/185, 186

[56] References Cited

U.S. PATENT DOCUMENTS

| | | | |
|---|---|---|---|
| 3,924,851 | 12/1975 | Winston | 482/79 |
| 3,967,459 | 7/1976 | Denis | 405/186 |
| 4,440,525 | 4/1984 | Perla | 405/186 |
| 4,455,718 | 6/1984 | Finnern | 405/186 |
| 5,076,575 | 12/1991 | Eylander | 405/186 |

FOREIGN PATENT DOCUMENTS

| | | |
|---|---|---|
| 857 753 | 12/1952 | Germany . |
| 1 568 081 | 5/1980 | United Kingdom . |
| 2 280 840 | 2/1995 | United Kingdom . |

*Primary Examiner*—Jesus D. Sotelo
*Attorney, Agent, or Firm*—Kane, Dalsimer, Sullivan, Kurucz, Levy, Eisele and Richardson, LLP

[57] ABSTRACT

A diving ballast (131) is adapted to be fitted to a scuba tank, so as to replace or at least supplement a waist-fitted weight-belt. The diving ballast (131) comprises an elongate flexible strap formed with open-ended weight-receiving holsters (122) therein and a plurality of weights (126) each having expanded ends and a waisted portion (127) defined between the expanded ends. Each weight is of such dimensions in relation to a weight-receiving holster (122) so that the expanded end of the weight can be worked through the holsters so that the weighted portion is held captive within the holster. The expanded end of the weight can only be worked through the holster when the strap is slack and the waisted portion (127) is held captive by the material of the holster when the strap is under tension along its length. The diving ballast extends to a waist-fitted weightbelt of the type described, as well as to an ankle-belt having a similar configuration. The invention further extends to a diving ballast system incorporating all three types of ballast.

19 Claims, 4 Drawing Sheets

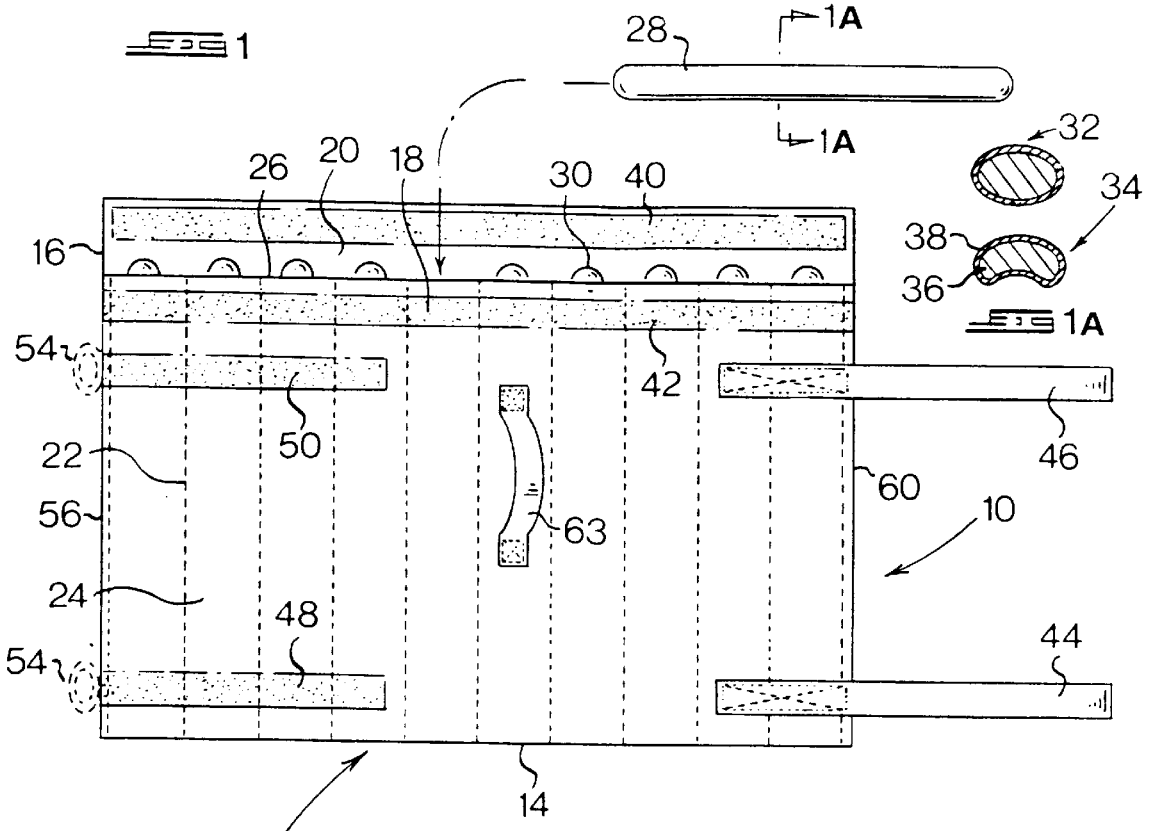
1
28
1A
1A
32
34
38
36
1A
26
20
18
30
40
16
54
42
50
46
22
60
56
63
10
24
48
44
54
14
12
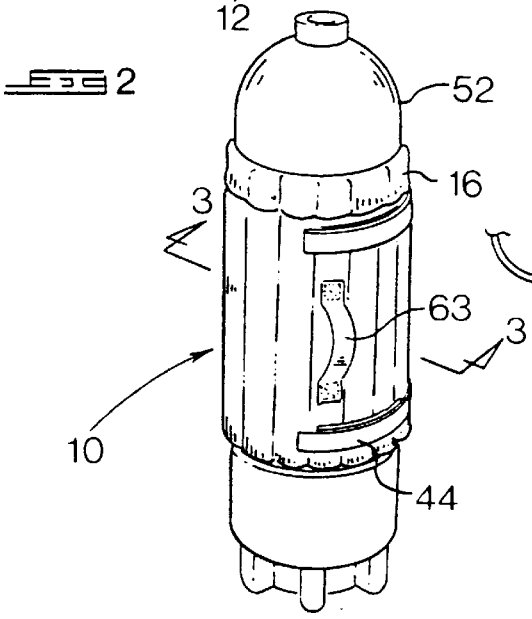
2
52
16
3
63
3
10
44
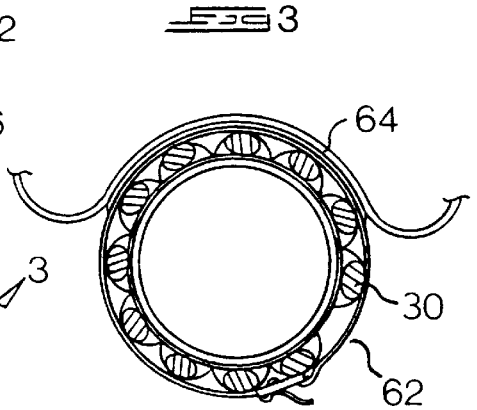
3
64
30
62

Fig 4
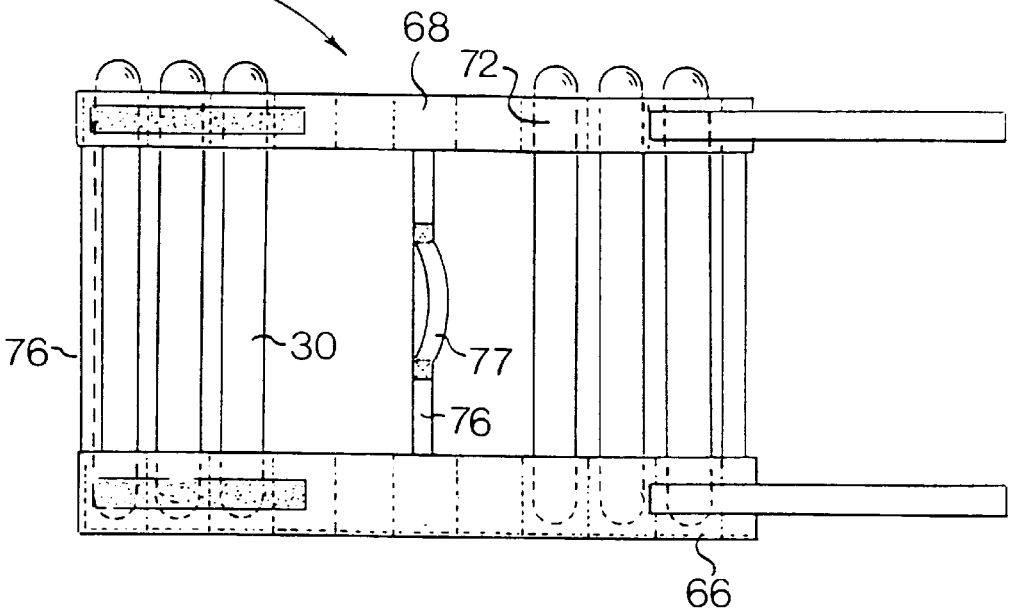
Fig 5
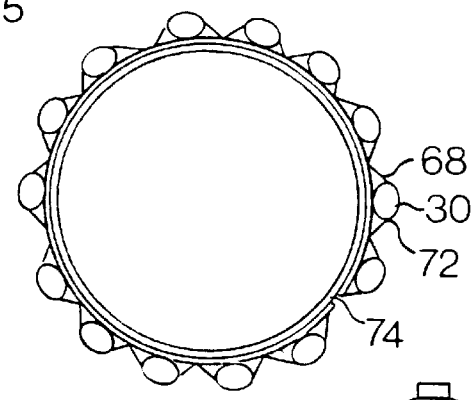
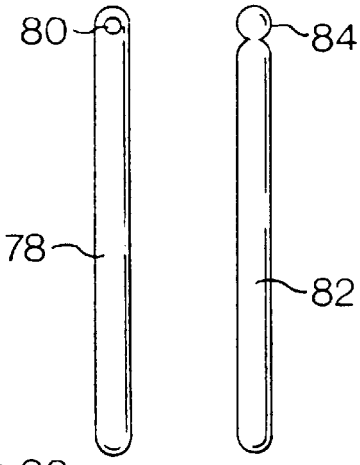
Fig 6
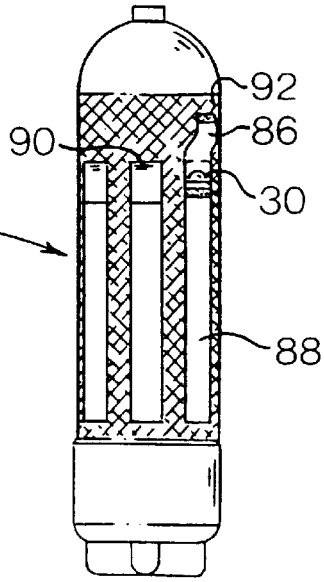
Fig 7

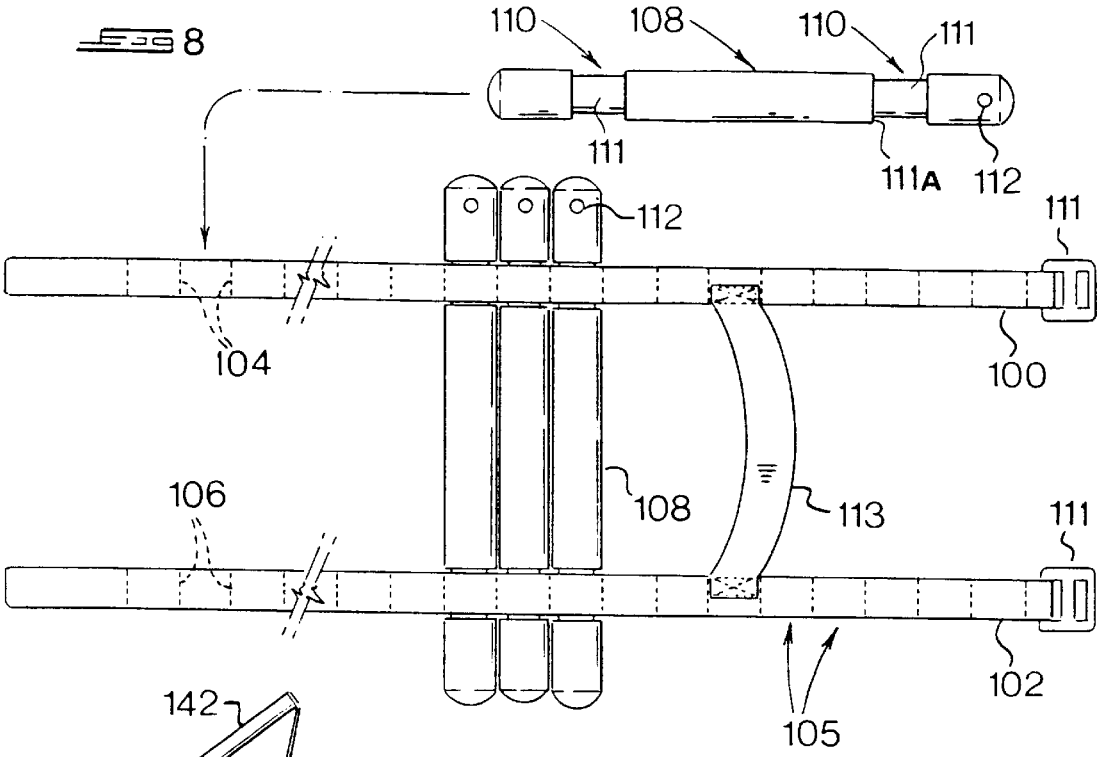
8
110
108
110
111
111
111A
112
112
111
104
100
106
108
113
111
102
105
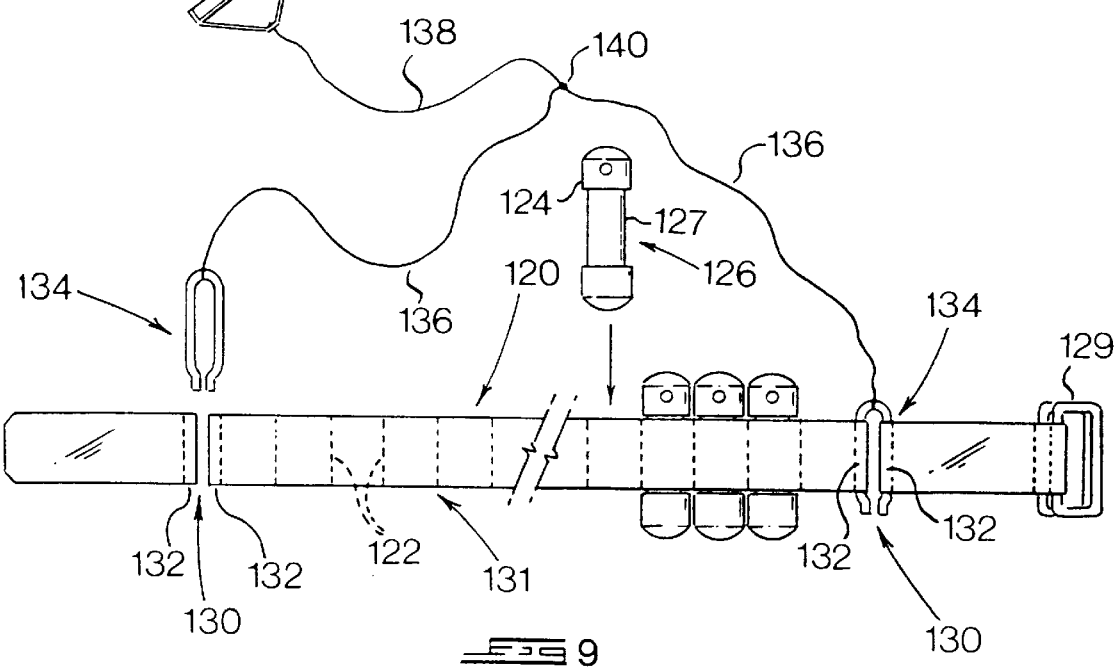
142
138
140
136
124
127
126
134
136
120
134
129
132
132
122
131
132
132
130
130
9

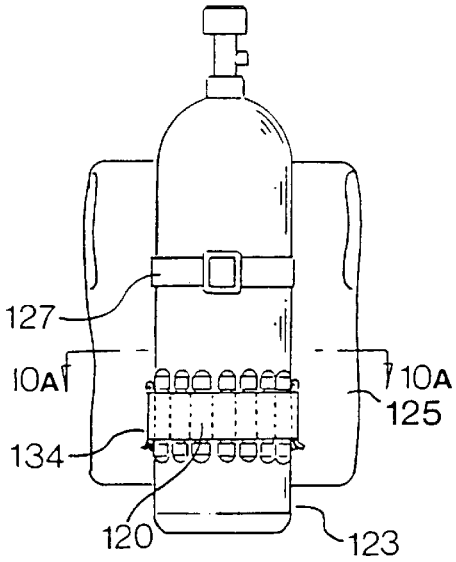
10
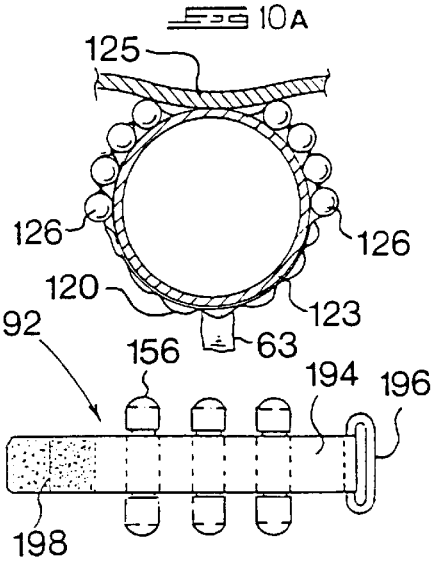
14
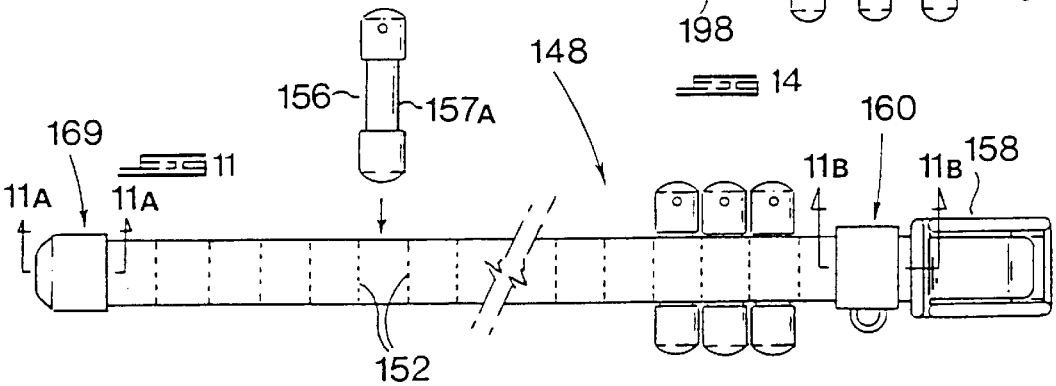
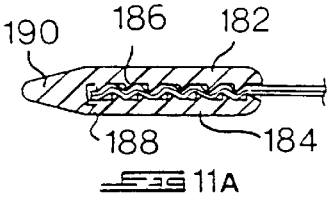
11A
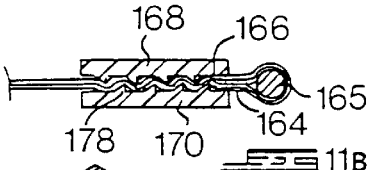
11B
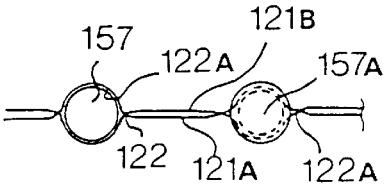
12
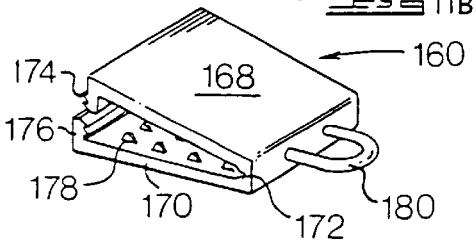
13

DIVING BALLAST

BACKGROUND TO THE INVENTION

THIS invention relates to a diving ballast.

Weightbelts are most commonly used as a ballast for scuba divers. These belts generally comprise a length of webbing onto which a selected number of apertured weights may be threaded, depending on the ballast required for a particular diver.

As they are separate and heavy items, weightbelts of this type are generally inconvenient to transport. Further, when diving from a boat, the weightbelts are usualy stored at a position remote from the divers in the bow of the boat. When donning equipment, various weightbelts then have to be identified and passed to their owners. This takes up additional time in the pre-dive routine.

SUMMARY OF THE INVENTION

According to a first aspect of the invention there is provided a diving ballast which is adapted to be fitted to a scuba tank, so as to replace or at least supplement a waist-fitted weightbelt, the diving ballast comprising a girdle which is adapted to be fitted around the belly of the scuba tank, the girdle being formed from a flexible material which is shaped and sized to be wrapped around the elongate round cylindrical profile of the scuba tank, and including a plurality of locating holsters for selectively locating a plurality of weights.

In a preferred form of the invention, the girdle comprises an elongate flexible strap formed with open-ended, tubular, weight-receiving holsters therein and a plurality of weights each having expanded ends and a waisted portion defined between the expanded ends, each weight being of such dimensions in relation to a weight-receiving holster than an expanded end of the weight can be worked through the holster so that the waisted portion locates and is held captive within the holster.

Preferably, the expanded end of the weight can only be worked through the holster when the strap is slack and the waisted portion is held captive by the material of the holster when the strap is under tension along its length.

Conveniently, the flexible strap is defined by elongate superimposed lengths of webbing which are joined together at spaced intervals along parallel join lines which extend transversely relative to the length of the webbing so as to define the holsters, the lengths of webbing typically being stitched together along the join lines.

Advantageously, the girdle is formed with fastening means for allowing it to be secured around the tank.

In one form of the invention, each locating holster is in the form of a blind elongate pocket, the ballast including a set of elongate weights which are dimensioned to fit into the pockets, the weights being formed with gripping formations towards operatively exposed ends thereof for facilitating removal thereof from the pockets.

The girdle may comprise upper and lower straps, each strap being formed with weight-receiving holsters.

In one form of the invention, the holsters in the lower strap may be in the form of pockets arranged to receive the operatively lower ends of the weights, and the holsters in the upper strap are open-ended so as to allow the passage of the weights therethrough.

Alternatively, the weight-receiving holsters of the upper and lower straps are open-ended, the ballast comprising a series of elongate weights formed with operatively upper and lower waisted portions, the dimensions of the weights in relation to the holsters being such that the weights can be worked through the holsters so that the waisted portions are held captive within the weight-receiving holsters by engagement of the holster material within the waisted portions.

In a further version of the invention, the girdle comprises a tubular section of netting which forms a snug fit around the round cylindrical belly of the scuba tank, the tubular netting including holsters in the form of a series of elongate, weight-receiving pockets which extend in a direction parallel to the main axis of the tank.

The girdle may be formed with a handle positioned to allow the scuba tank to be carried when the girdle is fastened around the tank.

The diving ballast may include ditching means for permitting at least a portion of the girdle which carries weights to be ditched rapidly from the tank, in which case the girdle includes at least one discontinuity and means for holding the girdle on either side of the discontinuity together, such means being rapidly releasable to separate the girdle at the discontinuity and permit at least a portion of the girdle, carrying weights, to fall free.

The girdle holding means may comprise a U-shaped clip, the legs of which locate in pockets in the girdle on either side of the discontinuity and a cable attached to the clip such that a sharp tug applied to the cable withdraws the legs of the clip from the pockets and allows the girdle to separate.

In one form of the invention, the girdle may include at least two such discontinuities each held together by a clip, with a cable arrangement being attached to all the clips such that a tug on the cable releases all the clips simultaneously and allows at least one section of the girdle, carrying weights, to fall free.

According to a further aspect of the invention there is provided a diving ballast comprising a weightbelt dimensioned to be fitted around the waist of a diver, the weightbelt comprising an elongate flexible strap formed with open-ended, tubular, weight-receiving holsters therein, a plurality of weights each having expanded ends and a waisted portion defined between the expanded ends, each weight being of such dimensions in relation to a weight-receiving holster than an expanded end of the weight can be worked through the holster so that the waisted portion locates and is held captive within the holster, and adjustable fastening means for fastening the weightbelt around the waist of the diver.

Typically, the fastening means comprises an end clasp arranged to be clamped to a free threading end of the strap, and an intermediate clasp arranged to fix a buckle to an opposite end of the strap.

In one form of the invention, the end clasp and the intermediate clasp comprise a pair of jaws having locking formations for clamping the jaws together over the strap and tooth-like gripping formations for gripping the strap.

According to a still further aspect of the invention there is provided a diving ballast comprising an ankle-belt dimensioned to be fitted around an ankle of a diver, the ankle-belt comprising an elongate flexible strap formed with open-ended, tubular, weight-receiving holsters therein and a plurality of weights each having expanded ends and a waisted portion defined between the expanded ends, each weight being of such dimensions in relation to a weight-receiving holster than an expanded end of the weight can be worked through the holster so that the waisted portion locates and is held captive within the holster, and fastening means for fastening the ankle-belt around the ankle of the diver.

The flexible strap of the ankle-belt may be defined by elongate superimposed lengths of webbing which are joined together at spaced intervals along parallel join lines which extend transversely relative to the length of the webbing so as to define the holsters.

The invention extends to a diving ballast system including a diving ballast incorporating a tank ballast, a waist-fitted weightbelt and a pair of ankle-belts of the type described above, with the various ballasts being adjusted for a particular diver so as to ensure optimum buoyancy and weight distribution underwater.

By the term "scuba tank" is meant a round, elongate high pressure cylinder having a height which is at least equal to or greater than its diameter.

BRIEF DESCRIPTION OF THE DRAWINGS

Different aspects of the invention will now be described in more detail, by way of example only, with reference to the accompanying drawings in which:

FIG. 1 shows a top plan view of a first embodiment of a tank ballast when laid out flat;

FIG. 1A shows a cross-section of an elongate weight on the line 1A—1A of FIG. 1;

FIG. 2 shows a pictorial view of the tank ballast of FIG. 1 fitted in position on a scuba tank;

FIG. 3 shows a cross-section of the line 3—3 of FIG. 2;

FIG. 4 shows a second embodiment of the tank ballast of the invention;

FIG. 5 shows a top plan view of the tank ballast of FIG. 4 wrapped around the tank;

FIG. 6 shows two alternative embodiments of elongate weights forming part of the tank ballast of the invention;

FIG. 7 shows a pictorial view of a further embodiment of a tank ballast of the invention; and FIG. 8 illustrates another embodiment of a diving ballast according to the invention;

FIG. 9 illustrates a further embodiment of the invention;

FIG. 10 shows the embodiment of FIG. 9 fitted to a scuba tank;

FIG. 10A shows a cross-section of the scuba tank on the line 10A—10A of FIG. 10 fitted with another arrangement of weights;

FIG. 11 illustrates an embodiment of the invention in the form of a weightbelt;

FIG. 11A shows a cross-section on the line 11A—11A of FIG. 11;

FIG. 11B shows a cross-section on the line 11B—11B of FIG. 11;

FIG. 12 shows a top plan view of part of the weight belt of FIG. 11; and FIG. 13 shows a perspective view of a retaining clip forming part of the weight belt of FIG. 11.

FIG. 14 shows an ankle belt.

DESCRIPTION OF EMBODIMENTS

Referring first to FIG. 1, a first embodiment of the tank ballast 10 includes a girdle 12 which is formed from a sheet of suitable material such as canvas which is folded at a lower folded end 14, thereby forming a rear portion 16 which extends beyond the front portion 18 so as to define a flap 20. The rear and front portions are stitched together along vertical parallel stitching rows 22 so as to define a series of elongate pockets 24 which are closed at the folded end 14 and have openings 26 at their top ends. The pockets 24 are sized to accommodate elongate lead weights 28. When slid into the pockets 24, the top ends of the weights 28 protrude from the openings 26, as is shown at 30. The weights 28 may have a number of different cross-sectional profiles, including an oval profile such as that illustrated at 32 in FIG. 1A or a kidney-shaped profile such as that illustrated at 34. The weights 32 and 34 have a lead centre 36 and may be covered by a layer of paint or a plastics coating 38 which may be colour coded so as to designate different weight values.

The flap 20 has a Velcro® strip 40 sewn along its upper edge, and a corresponding Velcro® strip 42 is sewn onto the girdle 12 just below the openings 26, as a result of which the flap can be folded down and secured so as to prevent the weights 30 from falling out of the pockets 24.

Two spaced apart straps 44 and 46 are sewn onto one side of the girdle. The straps have a Velcro® undersurface, and a corresponding pair of Velcro® strips 48 and 50 are sewn onto the outer surfaces of the girdle at the opposite side thereof.

As is clear from FIG. 2, the girdle 12 is of such a length that it may be wrapped around the belly of a scuba tank 52, with the straps 44 and 46 being brought around and fastened to the respective straps 48 and 50 so as to clamp the girdle in position around the tank. The Velcro® strips 48 and 50 may be replaced with suitable eyes 54 through which the ends of the straps 44 and 46 may be threaded and then folded back, with suitable Velcro® patches on the straps 44 and 46 serving to anchor the straps back on themselves in a looped formation.

As is clear from FIG. 3, the length of the girdle is such that the side edges 56 and 60 of the girdle meet when it is wrapped around the tank. Further, the girdle has a width which allows it to cover the entire cylindrical belly of the tank. Naturally, the length of the girdle will vary in accordance with the diameter of the tank, which will in turn vary depending on the capacity of the tank and whether the tank is an aluminium, steel or composite tank.

In FIG. 3, it can clearly be seen how the girdle does not contribute significantly to the overall diameter of the tank when the weights 30 are in position. As a result, the anchoring strap 62 of a jacket-type buoyancy compensating device (BCD) 64 can easily be fitted around the girdle and clamped in position. In order to assist in carrying the tank ballast 10 both singly and when fitted around the scuba tank 52, a handle 63 is stitched onto one of the pockets 24.

Referring now to FIG. 4, an alternative embodiment of a tank ballast 65 of the invention is shown. In this version, a girdle is provided in the form of lower and upper straps 66 and 68. The lower strap 66 is formed with a number of spaced apart pockets 70 and the upper strap 68 is formed with a corresponding array of loops 72, as can clearly be seen in FIG. 5. The pockets 70 and loops 72 are sized to accommodate elongate lead weights 30, and the straps 66 and 68 terminate in suitable adjustable fastening arrangements such as buckles or Velcro® patches which allow the straps to be tightened around the belly 74 of a scuba tank, as is clear from FIG. 5. The straps 70 and 72 may optionally be connected by means of vertically extending bridging strips 76 which are parallel to the elongate weights 30. The straps 66 and 68 may be fastened around the belly 74 of the tank either before or after the weights 30 have been inserted. A similar carrying handle 77 may be stitched to one of the bridging strips 76 for assisting in carrying the tank ballast 65 and the tank 52.

Referring now to FIG. 6, a third embodiment 78 of an elongate weight is shown which has an aperture 80 formed at one end thereof. The aperture 80 effectively defines a pull ring for enabling the weight 78 to be extracted from the pocket within which it is housed. An alternative version 82 of a weight is shown with an uppermost lifting knob 84 which is similarly provided to serve as a handle or finger grip for lifting the weight from the pocket in which it is housed.

In FIG. 7, a further embodiment of a tank ballast 85 of the invention is shown. In this version, the girdle is constituted by a protective netting tube 86 of the type which is normally used to protect the outer surface of the tank. A parallel series of elongate pockets 88 are sewn at intervals around the netting tube, and the pockets are sized and shaped to fit elongate weights 30. The pockets are provided with flaps 90 with suitable Velcro® patches 92 for retaining the weights in position once they have been inserted into the pockets.

FIG. 8 illustrates another embodiment of the invention which is similar in some respects to the embodiment of FIG. 4. In FIG. 8, there are upper and lower straps 100 and 102 forming the girdle and each consisting of two lengths of webbing material arranged against one another. The lengths of webbing material may be separate lengths or a single length folded back on itself. In each strap, the two lengths of webbing material are sewn together at intervals by rows of stitching 104, 106. Between the rows of stitching the lengths of webbing material form open-ended pockets or holsters 105, 107.

The FIG. 8 embodiment uses elongate round cylindrical lead weights 108 which are formed with annular recesses 110 defining waisted portions 111 towards either end. The weights are approximately 300 mm long, and typically have an outer diameter of 25 mm, with the waisted portions having a diameter of 18 to 20 mm, with the resultant shoulders 111A defining the annular recesses being approximately 3 mm wide. The weights are installed by working their ends through the open ended pockets defined by the rows of stitching until such time as the webbing material forming the pockets locates in the annular recesses 110. In practice, the rows of stitching are spaced apart to give pockets of such a size in relation to the weights that the extremities of the lead weights 108 cannot easily pass through the pockets and some effort is required to work them into position. Thus when the webbing locates in the annular recesses the weights are anchored and there is little chance of a weight merely falling out of its pocket.

As in the FIG. 4 embodiment, the ends of the straps 100 and 102 may carry appropriately positioned lengths of Velcro® to enable them to be fastened to one another to secure the girdle about the belly of the cylindrical scuba tank. Alternatively, as illustrated in FIG. 8, one end of each strap may carry a buckle 111 by means of which the straps, and hence the girdle, can be fastened about the scuba tank. A carrying handle or strap 113 may extend transversely between the straps 100 and 102.

Irrespective of which method is used to secure the straps about the tank, it will be appreciated that as the straps are pulled tight during such secural, the webbing material defining each pocket will pull tight against the lead weights, thereby reducing even further the chances of the weights working their way out of the pockets and falling free. Exactly the same is true of the embodiment of FIG. 4. The chances of a weight falling free are also reduced by the fact that the tank strap(s) or torque band(s) of the BCD will pass extremely tightly around the weights and hold them firmly against the surface of the tank. Slippage of the weights against the surface of the tank may also be inhibited if the weights are coated with soft rubber or plastics material with high friction properties. Rubber or plastic coatings will also diminish the chances of scratching or other damage to the tank surface.

As explained with reference to FIG. 6, at least the operatively upper ends of the weights can be formed with holes 112 to facilitate gripping and removal when necessary.

Given the length of the weights in embodiments such as those seen in FIGS. 1, 4, 7 and 8, typically of the order of 300 mm, it will be appreciated that each weight may have a considerable mass, and typically of up to 1.5 kilograms. This in turn means that only a few weights may be necessary for a diver to achieve the correct weighting to suit his particular circumstances.

In each of the embodiments described so far, the diving ballast is fixed to the tank by the tank strap(s) in a manner preventing rapid "ditching" of the weights should this ever be necessary in an emergency situation, such as an emergency swimming ascent. FIGS. 9 and 10 illustrate another embodiment of the invention which has the facility for rapid ditching of weights in an emergency and in which the girdle is formed by a single strap 120. Like the straps 100 and 102 in FIG. 8, and as is shown in FIG. 12, the strap 120 is formed by two lengths 121A and 121B of webbing material, either separate lengths or a single length folded back on itself. The lengths of webbing material are sewn together at intervals indicated by the rows of stitching 122, thereby forming open-ended pockets 122A. In this case, the lead weights 124 are relatively short compared to the weights 108 in FIG. 8. Each weight is formed with a central annular recess 126 defining a waisted portion 127. As in FIG. 8, the ends of the weights are worked forcibly through the pockets until such time as the webbing material locates in the recess to anchor the weights so that, once again, there is little chance of the weights falling free of their own accord.

The FIG. 9 embodiment is fastened to the scuba tank either above or below the tank strap by means of which the tank is secured to the BCD. FIG. 10 shows the strap secured to the scuba tank 123 below the tank strap 127 of a BCD 125. Thus in this embodiment, the tank strap does not encircle the weights. In cases where the BCD has two tank straps, the strap 120 is fastened about the belly of the tank above the upper strap or below the lower strap. One end of the single strap 120 carries a double-ring buckle 129 through which the other end of the strap can be threaded in the normal way to enable the strap to be fastened tightly about the belly of the scuba tank. As an alternative to the use of a buckle, the ends of the strap may carry appropriately positioned and orientated strips of Velcro® for the purposes of securing them to one another about the tank.

As in the relevant previous embodiments, the tightening of the girdle strap about the belly of the tank also draws the webbing material tightly into engagement with the weights, further reducing the chances of their coming free. The weights can be coated with rubber or plastic material, which may once again be coloured to indicate the magnitude of the weight, to increase the friction against the surface of the tank and also to prevent damage to the tank.

As indicated above, the embodiment of FIGS. 9 and 10 has the facility for rapid ditching of weights. This is achieved with two discontinuities 130 along the length of the strap. On each side of each discontinuity, the strap is sewn to form a narrow, open ended pocket 132. A generally U-shaped clip 134, typically of stainless steel, is used to secure the ends of the strap together at each discontinuity. As illustrated, the legs 136 of the clip are passed through the pockets 132, so that inwardly bent regions of the legs locate beyond the pocket to prevent ready withdrawal of the legs from the pockets. Strong, flexible cables 136 are secured to the bight portions of the clips. The cables are secured to a further, single cable 138 at a point 140, the cable 138 terminating in a handle 142.

In practice, the clips are inserted into their pockets from the top, and the lengths of cables 136 and 138 are such that in use the diver can position the cable 138 over his shoulder with the handle 142 in a position in front of him in a readily accessible position. If it becomes necessary to ditch the ballast, the diver merely grips the handle and gives it a sharp tug. This pulls the clips upwardly relative to the strap 120 and withdraws the legs of the clips from the pockets 132, thereby allowing the strap to separate at the discontinuities 130. In the result, that section 131 of the strap between the discontinuities, i.e. the part carrying the weights, can fall free from the tank.

In the embodiment of FIGS. 9 and 10, it is preferred to have two discontinuities at which the strap 120 can separate, although a single discontinuity is also feasible. With a single discontinuity the possibility exists that the strap 120 could get caught up between the tank and the rear surface of the BCD and hence not fall free even when the clip is pulled free. However, with two discontinuities, one located on each side of the tank and with the weights between them and located against the outside of the tank as seen in FIG. 10, withdrawal of the clips will lead to certain release of the middle section 131 of the strap and hence of the weights which it carries.

The above-described provision of discontinuities in the strap and of removable clips is but one of many different weight-ditching possibilities within the scope of the invention. For instance, in a case where there is a discontinuous strap, the or each discontinuity could be bridged by a strip of Velcro® engaging with counter-strips of Velcro® provided on opposite sides of the discontinuity. The bridging strip of Velcro® would then be attached to a length of cable which could be tugged to rip that strip free, thereby separating the strap and allowing a relevant section thereof to fall free with the weights.

As yet another alternative, the weights could be located in pockets which have open lower ends and which are carried by a girdle strap encircling the tank above or below the tank strap. The otherwise open lower ends of the pockets are closed by a Velcro® strap engaging counter-strips of Velcro® on either side of the lower ends of the pockets. When it is necessary to ditch the weights, the Velcro® strip which closes the lower ends of the pockets is ripped free by tugging on a cable to which the strip is attached. This opens the lower ends of the pockets and allows the weights to fall free.

As an alternative to closure of the pockets by means of a Velcro® strip, it would also be possible to provide a lacing arrangement to close the pockets. The lacing is threaded through eyes in the pockets and strap and is so arranged that it can be pulled free. Thus a sharp tug applied to the lacing via a cable accessible to the diver pulls the lacing free and opens the pockets to allow the weights to fall out.

It will be appreciated that in the embodiments described in the preceding paragraphs it is important for the weights to be capable of free sliding movement out of their pockets, so the pockets would generally be oversize with respect to the weights.

In FIG. 10A, a cross-section on the line 10A—10A of FIG. 10 is illustrated with the weights 126 shown arranged in a manner which is designed to prevent or at least limit the tank from rolling when it is on its side, and when the BCD has been removed. As is clear from FIG. 10A, the weights 126 are positioned in pairs on opposite sides of the tank 123 adjacent the BCD 125. In the particular embodiment illustrated, the strap 120 is not provided with a weight-ditching facility. In this embodiment, the weights 126 are not used independently, but are used to supplement other elements of a ballast system of the invention, which may include waist and ankle belts described further on in the specification.

FIG. 11 illustrates a further embodiment of diving ballast according to the invention. In this embodiment, the ballast is not adapted to be secured to the scuba tank, but is in the form of a belt 148 which the diver will wear about his waist. As illustrated, the belt has a single strap 150 consisting of two lengths of webbing material. These may either be independent lengths of webbing material or a single length of woven canvas or polypropylene webbing material folded back on itself. In either event, the lengths of webbing material are sewn to one another as indicated by four rows of stitching 152 to form a series of open-ended pockets like those shown at 122A, each of which are approximately 48 mm wide.

Lead weights 156, shaped similarly to the weights 124 seen in FIG. 9, are worked into the pockets and are anchored there by engagement of the webbing material in the central annular recesses formed in the weights. In the particular embodiment illustrated, the enlarged upper and lower ends 157 of each weight have a diameter of 30 mm, with the central waisted portion 157A having a diameter of approximately 24 mm, with the shoulders 157B between the expanded and waisted portions 157 and 157A having a width of approximately 3 mm. The width of the shoulders is preferably greater than or at least equal to the thickness of the webbing. The total length of a 1 kg weight is approximately 100 mm, with the waisted portion 157A being 50 mm long and the expanded ends 157 similarly having a length of approximately 50 mm. In the case of a 600 g weight, the length of the expanded end portions or heads 157 is reduced to approximately 25 mm. The belt 148 is provided with a conventional weightbelt buckle 158 at one end and is worn in the conventional manner about the diver's waist by arranging the belt to encircle the waist, passing the free end of the belt through the buckle and then locking the buckle. If the belt is pulled tight, the increased frictional engagement between the webbing material of the belt and the weights themselves will reduce the chances of the weights working their way out of the pockets 122A.

In FIG. 12, it can clearly be seen how each pocket 122A can be expanded to allow the enlarged upper or lower ends 157 of the weights to be worked through the pocket to a position in which the pocket surrounds the recessed or waisted portion 157A of the weight, with any tension in the weight belt serving to stretch the pocket and to bring the lengths 121A and 121B of webbing towards one another so as to prevent the weights from working themselves loose.

The weightbelt illustrated in FIG. 11 includes an intermediate clasp 160 and an end clasp 162. The intermediate clasp 160 serves to clamp the free end 164 of the strap against a main portion 166 of the strap once it has been folded back over the buckle shaft 165 in the manner illustrated in FIG. 11B. The intermediate clasp 160 is illustrated in more detail in FIG. 13. The clasp is injection moulded from a hard plastics material, and comprises a pair of jaws 168 and 170 which are connected along a live hinge 172. The free ends of the jaws 168 and 170 are formed respectively with saw-tooth projections 174 and 176 which are arranged to be locked into engagement with one another as the jaws 168 and 170 are closed. The interior surfaces of the jaws 168 and 170 are formed with teeth 178 which are arranged to bite into the portions of webbing 164 and 166, thereby holding them firmly in position when the jaws are closed. A D-ring 180 extends from the hinged end of the clasp 160. The end clasp 162 is similarly formed from a pair of jaws 182 and 184 with teeth 186 extending from the interior surfaces of the jaws and the jaws being held together by means of corresponding saw-tooth projections 188. The leading edge 190 of the end clasp tapers inwardly so as to allow the end clasp to be threaded into engagement with the buckle 158. The main function of the end clasp is to hold together the frayed ends of the webbing once it has been cut to size, and to facilitate threading of the belt into the buckle.

The weightbelt assembly 148 of FIG. 11 is designed to be custom fitted at a dive shop. The desired length of belt is cut from a roll of webbing comprising two layers which are stitched together at regular intervals so as to define the pockets 122A. Once the weightbelt has been cut to size, the buckle 158 is fitted, the free end 164 of the belt is folded back and the intermediate clasp 160 is clamped into position. The opposite free end of the weightbelt is then fitted with an end clasp 162, and the desired number of weights are fitted to the weightbelt.

Referring now to FIG. 14, an ankle belt 192 is shown comprising a length of webbing 194 which is folded over and stitched at intervals so as to define pockets for insertion of the weights 156. One end of the ankle belt is fitted with a ring 196 and Velcro® 198 is fastened to the opposite free end of the belt, thereby allowing the ankle belt to be wrapped around the ankles, with the free end being passed through the ring 196 and anchored back into position.

In one form of the invention, the buoyancy system may comprise a tank belt of the type illustrated in FIG. 10A in combination with ankle belts 192 and a weightbelt 148. The purpose of the ankle belts is to ensure that the legs of a diver do not float above the torso, a phenomenon which is common amongst female divers. The weights on the tank belt provide for added stability owing to the fact that they are closer to the centre of buoyancy of the human body, which is in the region of the lungs. The weightbelt distributes the remainder of the ballast evenly, and in combination with the ankle belts allows for fine tuning of the buoyancy of a diver.

As in the case of conventional weightbelts, the belt 148 in FIG. 11 can be ditched in an emergency situation merely by disengaging the buckle 158 and allowing the whole belt to fall free of the waist.

The weights 156 in FIGS. 11 and 14 can, as in other embodiments, be rubber, plastic or powder coated. The rubber, plastic or powder coating can be coloured to indicate the magnitude of the weight in question.

In each of the embodiments described above in which there are open ended pockets through which the ends of the weights are worked, it is a simple matter to add or reduce the total weight when necessary. Variation of the total weight may, for instance be necessary when the diver transfers from fresh water to seawater, or when the diver wears different wetsuits or carries other equipment which affects his buoyancy in the water. In each case, with the strap in a loose condition, extra weights can be worked into vacant pockets, or excess weights worked out of relevant pockets, as the case may be, to achieve optimal weighting for each dive. This is considered to be a major advantage compared to conventional weightbelts in which the weights are threaded onto the belt and where interior weights cannot be removed without first removing weights near to the free, i.e. non-buckle end of the belt.

I claim:

1. A diving ballast which is adapted to be fitted to a scuba tank, so as to replace or at least supplement a waist-fitted weightbelt, the diving ballast comprising a girdle which is adapted to be fitted around the belly of the scuba tank, the girdle being formed from at least one elongate flexible strap which is shaped and sized to be wrapped around the elongate round cylindrical profile of the scuba tank, the strap being formed with open-ended, tubular, weight-receiving holsters therein, a plurality of weights each having expanded ends and a waisted portion defined between the expanded ends, each weight being of such dimensions in relation to a weight-receiving holster that an expanded end of the weight can be worked through the holster so that the waisted portion locates and is held captive within the holster.

2. A diving ballast according to claim 1 in which the expanded end of the weight can only be worked through the holster when the strap is slack and the waisted portion is held captive by the material of the holster when the strap is under tension along its length.

3. A diving ballast according to claim 1 in which the flexible strap is defined by elongate superimposed lengths of webbing which are joined together at spaced intervals along parallel join lines which extend transversely relative to the length of the webbing so as to define the holsters.

4. A diving ballast according to claim 3 in which the lengths of webbing are stitched together along the join lines.

5. A diving ballast according to claim 1 in which the girdle is formed with fastening means for allowing it to be secured around the tank.

6. A diving ballast according to claim 1 in which the girdle comprises upper and lower straps, each strap being formed with weight-receiving holsters.

7. A diving ballast according to claim 1 in which the girdle is formed with a handle positioned to allow the scuba tank to be carried when the girdle is fastened around the tank.

8. A diving ballast according to claim 1 which includes ditching means for permitting at least a portion of the girdle which carries weights to be ditched rapidly from the tank.

9. A diving ballast according to claim 8 in which the girdle includes at least one discontinuity and means for holding the girdle on either side of the discontinuity together, such means being rapidly releasable to separate the girdle at the discontinuity and permit at least a portion of the girdle, carrying weights, to fall free.

10. A diving ballast according to claim 9 in which the girdle holding-means comprises a U-shaped clip, the legs of which locate in pockets in the girdle on either side of the discontinuity and a cable attached to the clip such that a sharp tug applied to the cable withdraws the legs of the clip from the pockets arid allows the girdle to separate.

11. A diving ballast according to claim 10 in which the girdle includes at least two such discontinuities each held together by a clip, with a cable arrangement being attached to all the clips such that a tug on the cable releases all the clips simultaneously and allows at least one section of the girdle, carrying weights, to fall free.

12. A diving ballast comprising a weightbelt dimensioned to be fitted around the waist-of a diver, the weightbelt comprising an elongate flexible strap formed with open-ended, tubular, weight-receiving holsters therein, a plurality of weights each having expanded ends and a waisted portion defined between the expanded ends, each weight being of such dimensions in relation to a weight-receiving holster that an expanded end of the weight can be worked through the holster so that the waisted portion locates and is held captive within the holster, and adjustable fastening means for fastening the weightbelt around the waist of the diver.

13. A diving ballast according to claim 12 in which the expanded end of the weight can only be worked through the holster when the strap is slack and the waisted portion is held captive by the material of the holster when the strap is under tension along its length.

14. A diving ballast according to claim 12 in which the flexible strap is defined by elongate superimposed lengths of webbing which are joined together at spaced intervals along parallel join lines which extend transversely relative to the length of the webbing so as to define the holsters.

15. A diving ballast according to claim 14 in which the lengths of webbing are stitched together along the join lines.

16. A diving ballast according to claim 12 in which the fastening means comprises an end clasp arranged to be clamped to a free threading end of the strap, and an intermediate clasp arranged to fix a buckle to an opposite end of the strap.

17. A diving ballast according to claim 16 in which the end clasp and the intermediate clasp comprise a pair of jaws having locking formations for clamping the jaws together over the strap and tooth-like gripping formations for gripping the strap.

18. A diving ballast comprising an ankle-belt dimensioned to be fitted around an ankle of a diver, the ankle-belt comprising an elongate flexible strap formed with open-ended, tubular, weight-receiving holsters therein and a plurality of weights each having expanded ends and a waisted potion defined, between the expanded ends, each weight being of such dimensions in relation to a weight-receiving holster that an expanded end of the weight can be worked through the holster so that the waisted portion locates and is held captive within the holster, and fastening means for fastening the ankle-belt around the ankle of the diver.

19. A diving ballast according to claim 18 in which the flexible strap is defined by elongate superimposed lengths of webbing which are joined together at spaced intervals along parallel join lines which extend transversely relative to the length of the webbing so as to define the holsters.

* * * * *